US005149046A

United States Patent [19]

Kerley et al.

[11] Patent Number: 5,149,046

[45] Date of Patent: Sep. 22, 1992

[54] PAGE TURNING SYSTEM

[75] Inventors: James J. Kerley, Greenbelt; Wayne D. Eklund, Edgewood, both of Md.

[73] Assignee: The United States of America as represented by the Administrator, National Aeronautics & Space Administration, Washington, D.C.

[21] Appl. No.: 812,932

[22] Filed: Dec. 24, 1991

[51] Int. Cl.[5] ..... A47B 97/04

[52] U.S. Cl. ..... 248/453; 248/455; 248/463

[58] Field of Search ..... 248/453, 454, 455, 456, 248/459, 463, 465; 281/445, 33

[56] References Cited

U.S. PATENT DOCUMENTS

| | | | |
|---|---|---|---|
| 462,122 | 10/1891 | French | 248/453 |
| 706,228 | 8/1902 | Fleming | 248/456 |
| 819,910 | 5/1906 | Meyers . | |
| 903,050 | 11/1908 | Booth | 248/459 |
| 1,197,233 | 9/1916 | Plamondon | 248/453 |
| 1,947,053 | 2/1934 | Mason | 45/57 |
| 2,244,773 | 6/1941 | Hawk | 45/80 |
| 2,373,617 | 4/1945 | Tiryakian | 248/463 X |
| 2,786,299 | 3/1957 | Cosgrove | 248/463 |
| 3,017,148 | 1/1962 | Wathen | 248/459 U X |
| 3,603,554 | 9/1971 | Dickinson | 248/453 |
| 3,785,605 | 1/1974 | Parekh | 281/33 X |
| 3,889,914 | 6/1975 | Torme | 248/445 |
| 3,952,989 | 4/1976 | Hatcher | 248/453 |
| 3,954,246 | 5/1976 | Sparkman | 248/460 X |
| 4,496,126 | 1/1985 | Melton et al. | 248/447.2 |

FOREIGN PATENT DOCUMENTS

| | | | |
|---|---|---|---|
| 54814 | 1/1935 | Norway | 248/453 |

*Primary Examiner*—J. Franklin Foss

*Attorney, Agent, or Firm*—R. Dennis Marchant; Guy M. Miller; Paul S. Clohan, Jr.

[57] ABSTRACT

A device for holding reading materials for use by readers without arm mobility adapted to hold the reading materials in position for reading with the pages displayed to enable turning by use of a rubber tipped stick held in the mouth having a pair of rectangular frames for holding and positioning the reading material opened in reading posture with the pages displayed at a substantially unobstructed sighting position for reading with the pair of rectangular frames connected to one another by a hinge so the angle between the frames may be varied thereby varying the inclination of the reading materials. A pair of bent spring mounted wires for holding opposing pages of the reading material open for reading without substantial visual interference of the pages is mounted to the base and adjustable to the thickness of the reading material and having a variable friction adjustment so as to enable the force of the wires against the pages to be varied and also permitting manipulation of said pages by the stick employed by the reader.

4 Claims, 5 Drawing Sheets

PAGE TURNING SYSTEM

Origin of the Invention

The invention described herein was made in the performance of work under a NASA contract and by an employee of the United States Government and is subject to the provisions of Section 305 of the National Aeronautics and Space Act of 1958, Public Law 85-568 (72 Stat. 435; 43 U.S.C. §2457), and may be manufactured and used for governmental purposes without the payment of any royalties thereon or therefor.

TECHNICAL FIELD

This invention relates to book and newspaper holders for persons without arm mobility and more particularly it relates to an improved book holder for facilitating the turning of pages by such persons.

BACKGROUND ART

Various types of book holders exist in the prior art. Most of these holders, however, are not suitable for persons who have lost their arm mobility, e.g., quadriplegics. Some types of book holders have been proposed, the most recent being a Table Mounted Universally Positionable Book Holder Enabling Readers to Turn Pages Easily Without Hands, U.S. Pat. No. 4,496,126 issued to R. Stanley Melton. In this device, Melton provides a (1) set of clamps for mounting on a table for positioning, (2) an open rectangular framework for displaying an open book with (3) cover clamps to hold the book covers and having (4) a set of monofilament plastic lines for keeping the book open to display a pair of opposed pages and to facilitate the turning of the pages by the reader with a mouth manipulated rubber tipped stick. The clamp mount clamps on an edge of a table to hold the framework substantially vertically for reading in sitting position with two or three lines disposed horizontally across the open pages to hold them open and partially flattened for reading. When a conventional table moves over a hospital type bed, for example, and the framework is clamped to the edge of the table, it holds the book horizontally with the opened pages resting on the monofilamant lines.

One drawback of the prior art is the ability to handle different sizes of reading materials, i.e., from small paperback books to large newspapers. Another drawback is the method used to turn the pages. Some devices used automatic page turners, but they tended to be very expensive. (either devices, such as the one cited above, used a rubber tipped stick held in the mouth, which is suitable for some individuals but not for others; e.g., as the handicapped get older they lose much of their facial muscle power so if a rubber tipped stick is to be used it must be held by the jaws and not merely the mouth.

STATEMENT OF THE INVENTION

It is therefore an object of the present invention to provide a device that will hold various types and sizes of reading materials in a readable position for bedridden persons.

It is another object of the present invention to provide a means for persons without arm mobility to turn the pages of various types and sizes of reading materials.

It is a further object of the present invention to provide a page turner for older individuals who have limited muscle ability.

These and other objects are achieved by providing a Page Turning System according to the present invention. A Book holder is provided and comprised generally of a flat upright back support upon which a book, magazine, or newspaper is placed, a flat base which can be placed on a table, lap, etc., a bracket, and a pair of bent wire page holders. The back support is connected to the base by a hinge which allows the book holder to pivot to various degrees of inclination, including completely flat for storage. The bracket is mounted at the base of the back support and is used for mounting the two page holders, a wire, and a page turner holder.

The back support is supported in an upright position by a brace, which is hinged to the base by a piano hinge, and supported at the upper end by a bent metal bracket. A plurality of brackets can be placed on the back support to allow various angles of inclination to the back support. A spring, which can be a rubber band, bungee, etc., is connected between a bracket, fixed to the base, and another bracket, fixed to the back support, which keeps the brace firmly in position against the bracket. The back support also has a pair of wings, which slide into and out of a bracket at the back of the back support, which allows the back support to widen at the top for newspapers and other large reading materials. A wire, which extends from the bracket to a top support, is useful in holding some types of reading materials; it is not necessary for other types of reading materials.

Mounted to the front bracket are the two page holders, which essentially are two pieces of bent wire. At the base of each page holder is a cylinder into which each page holder is fastened. The cylinders can be made from plastic, and each has a hole through the center (not shown) through which a rod is placed. The rod extends from the left tab of the front bracket, through the center of the front bracket, to the right tab of the front bracket, and allows the page holders to rotate about their axis. The rod has threaded portions as shown, and is fixed to the two tabs by four nuts. The cylinders are not prevented from lateral movement in this embodiment, except by the tension provided by the two springs. To capture the end of each spring is a cap, which can also be made from plastic. The tension on each spring is adjusted by the nuts as shown. As the nuts adjacent the caps are tightened, the spring tensions are increased and consequently the friction between innermost cylinders and the center part of the front bracket is increased. This allows for adjustment of the page holders against the back support. In other words, if the page holders need to be held tightly against the back support, then the tension on the springs is increased; if the page holders can be loose against the back support, then the tension on the springs can be decreased. The adjustment of the page holders is left up to the user allowing flexibility in the use of the book holder.

FIG. 8 shows how a quadriplegic would use the book holder to hold a magazine and to turn its pages. The magazine lies flat against the back support and is supported in the middle by a wire. The two page holders are positioned against the pages of the magazine so that they lie flat. When the quadriplegic wishes to turn the pages of the magazine, he uses a page turner, holding it in his mouth. The page turner, shown in detail in FIG. 3, consists of a mouth piece, two tubes, and an endpiece. One tube is larger that the other tube allowing one tube to slide into and out of the other tube enabling the user to adjust the length of the page turner. FIG. 4 shows a side view of the page turner, enabling one to see that the mouth piece is wide and tapered enabling the quadriplegic to grip the page turner with his or her teeth and use the muscles in his or her jaws to manipulate the page turner; this feature is especially important for older individuals who may have decreased ability in the tongue and other muscles found in the mouth. An alternate embodiment for the end piece of the page turner is shown in FIG. 5; in this embodiment, an eraser type end is provided o the end of one tube; this end is called an eraser end because it resembles the eraser of a standard pencil; in fact, the end can consist of a purchased pencil eraser end.

DETAILED DESCRIPTION OF THE INVENTION

Figure 1:
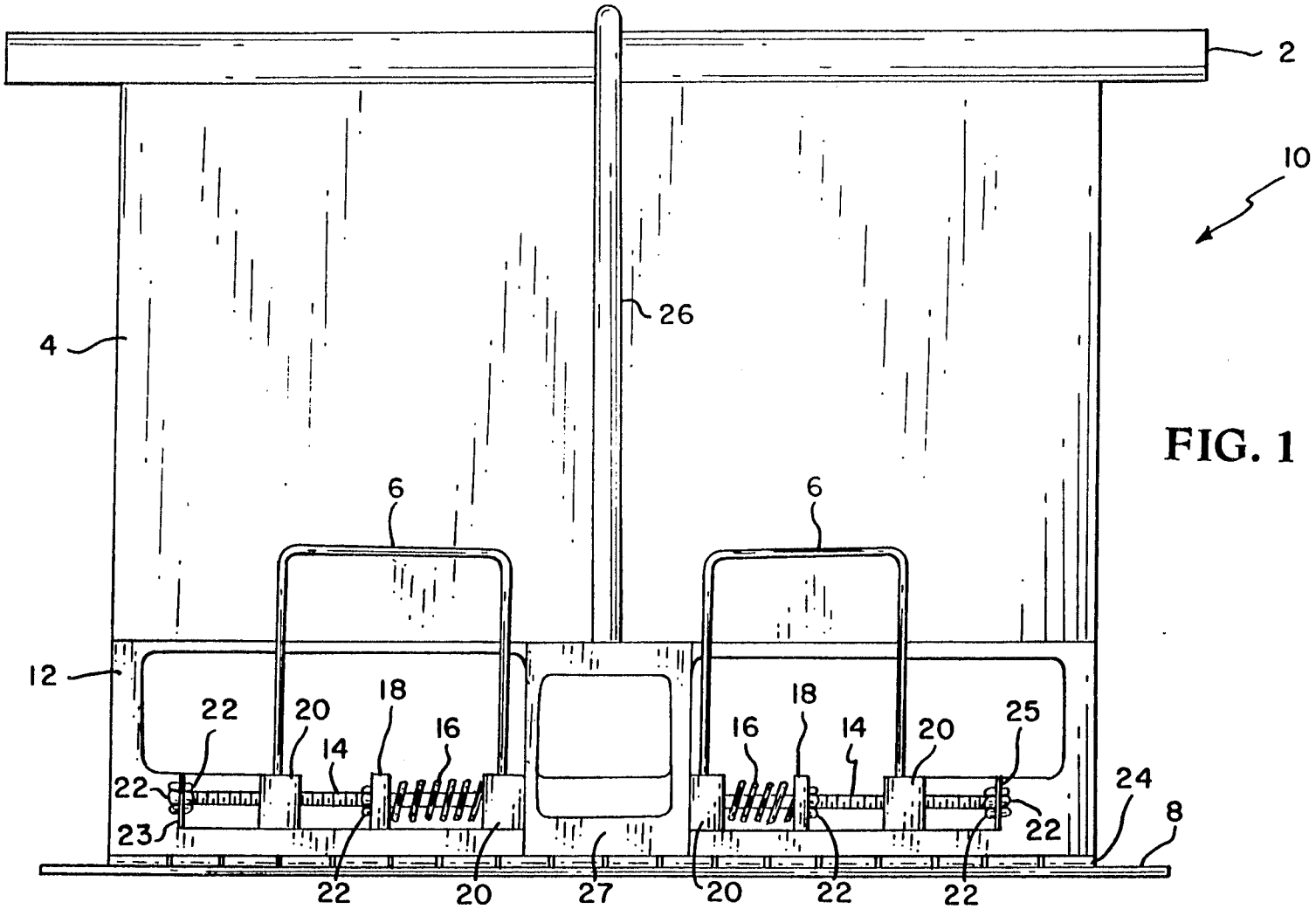
FIG. 1 is a front view of the book holder portion of the Page Turning System.
Figure 2:
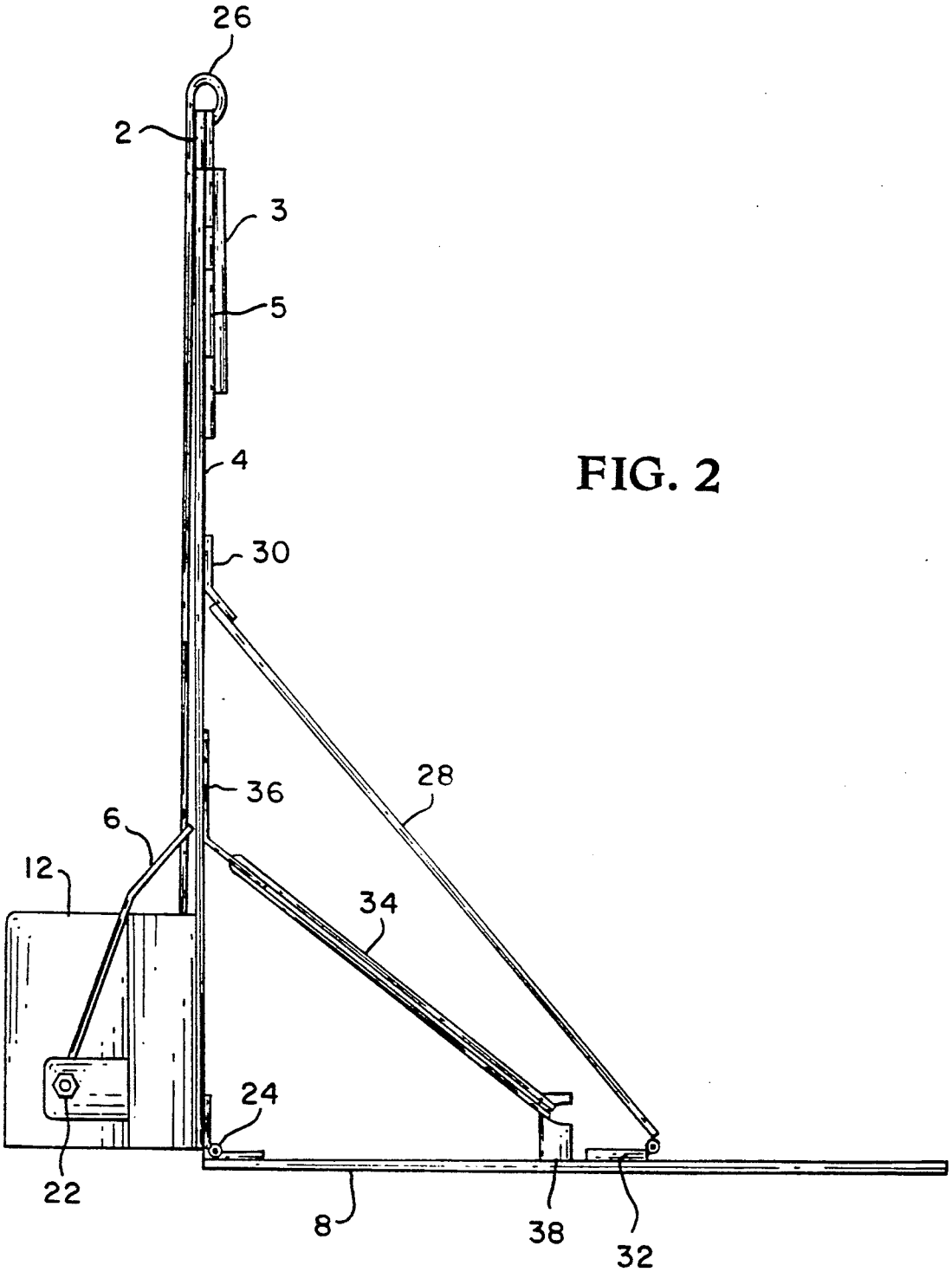
FIG. 2 is a side view of the book holder portion of the Page Turning System.

Referring now to FIGS. 1 and 2, a book holder 10 is shown for use in the Page Turning System of the present invention. Book holder 10 is comprised generally of a flat upright back support 4, upon which a book, magazine, or newspaper is placed, a flat base 8 which can be placed on a table, lap, etc., a bracket 12, and a pair of bent wire page holders 6. Back support 4 is connected to base 8 by hinge 24 which allows book holder 10 to pivot to various degrees of inclination, including completely flat for storage. Back support 4 also has connected a top support 2 which can be useful for larger reading items such as newspapers. Bracket 12 is mounted at the base of back support 4 and is used for mounting the two page holders 6, wire 26, and a page turner holder (not shown in FIG. 1).

Back support 4 is supported in an upright position by brace 28, which is hinged to base 8 by piano hinge 32, and supported at the upper end by a bent metal bracket 30. A plurality of brackets 30 can be placed on back support 4 to allow various angles of inclination to back support 4. A spring 34, which can be a rubber band, bungee, etc., is connected between bracket 38, fixed to base 8, and bracket 36, fixed to back support 4, which keeps brace 38 firmly in position against bracket 30. Back support 4 also has a pair of wings 5, which slide into and out of bracket 3 at the back of back support 4, which allows back support 4 to widen at the top for newspapers and other large reading materials. Wire 26, which extends from bracket 12 to top support 2, is useful in holding some types of reading materials; it is not necessary for other types of reading materials.

Mounted to bracket 12 are the two page holders 6, which essentially are two pieces of bent wire. At the base of each page holder 6 is a cylinder 20 into which each page holder 6 is fastened. Cylinders 20 can be made from plastic, and each has a hole through the center (not shown) through which rod 14 is placed. Rod 14 extends from the left tab 23 of bracket 12, through the center 27 of bracket 12, to the right tab 25 of bracket 12, and allows page holders 6 to rotate about its axis. Rod 14 has threaded portions as shown, and is fixed to tabs 23 and 25 by four nuts 22. Cylinders 20 are not prevented from lateral movement in this embodiment, except by the tension provided by springs 16. To capture the end of each spring 16 is a cap 18, which can also be made from plastic. The tension on each spring 16 is adjusted by nuts 22 as shown. As nuts 22 adjacent caps 18 are tightened, the spring 16 tensions are increased and consequently the friction between innermost cylinders 20 and center 27 is increased. This allows for adjustment of page holders 6 against back support 4. In other words, if page holders 6 need to be held tightly against back support 4, then the tension on springs 16 is increased; if page holders 6 can be loosely against back support 4, then the tension on springs 16 can be decreased. The adjustment of page holders 6 is left up to the user allowing flexibility in the use of book holder 10.

Figure 3:
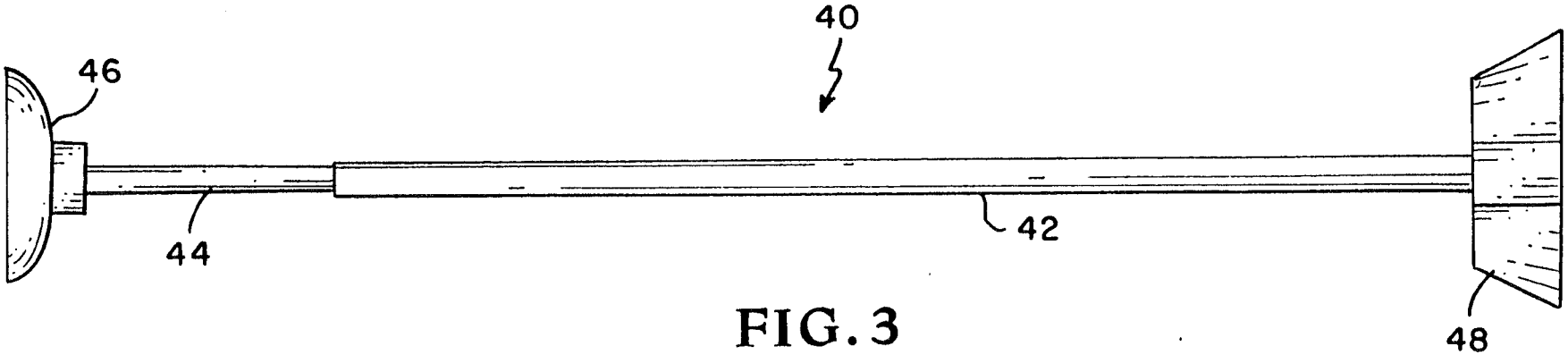
FIG. 3 is a top view of the page turner used in the Page Turning System.
Figure 4:
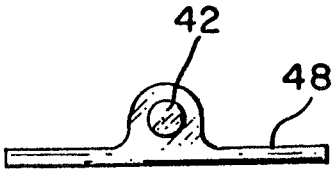
FIG. 4 is a side view of the mouth piece used on the page turner.
Figure 5:
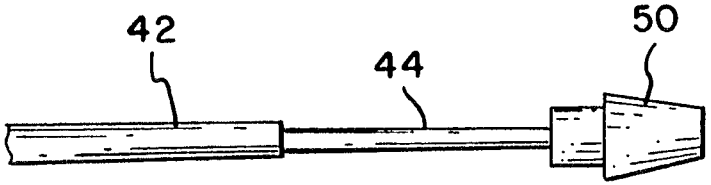
FIG. 5 is a view of an alternate end for the page turner.
Figure 8:
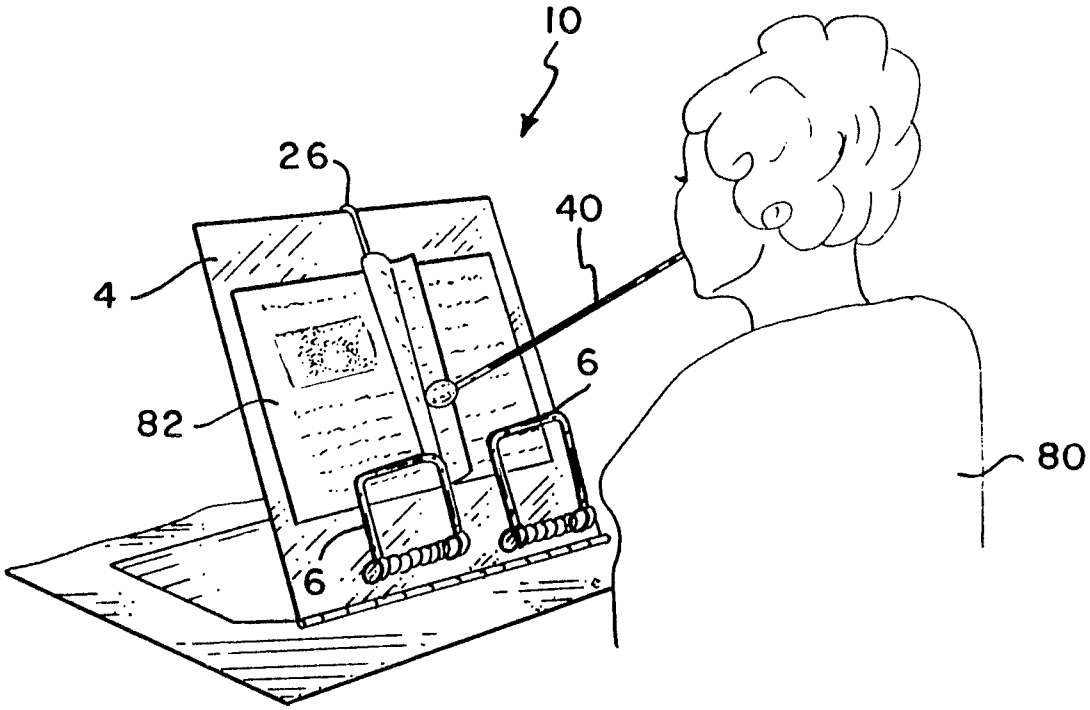
FIG. 8 is a view of the page turning system in use.

FIG. 8 shows how a quadriplegic 80 will use book holder 10 to hold a magazine 80 and to turn its pages. The magazine 80 lies flat against back support 4 and is supported in the middle by wire 26. Page holders 6 are positioned against the pages of magazine 82 so that they lie flat. When quadriplegic 80 wishes to turn the pages of magazine 82, he uses page turner 40, holding it in his mouth. Page turner 40, shown in detail in FIG. 3, consists of a mouth piece 48, tubes 42 and 44, and endpiece 46; in this embodiment endpiece 46 is a suction cup end. Tube 42 is larger that tube 44 allowing tube 44 to slide into and out of tube 42 enabling the user to adjust the length of page turner 40. FIG. 4 shows a side view of page turner 40, enabling one to see that mouth piece 48 is wide and tapered enabling quadriplegic 80 to grip page turner 40 with his or her teeth and use the muscles in his or her jaws to manipulate page turner 40; this feature is especially important for older individuals who may have decreased ability in the tongue and other muscles found in the mouth. An alternate embodiment for the end piece of page turner 40 is shown in FIG. 5; in this embodiment, an eraser type end 50 is provided on the end of tube 44; end 50 is called an eraser end because it resembles the eraser of a standard pencil; in fact, end 50 can consist of a purchased pencil eraser end.

Figure 6:
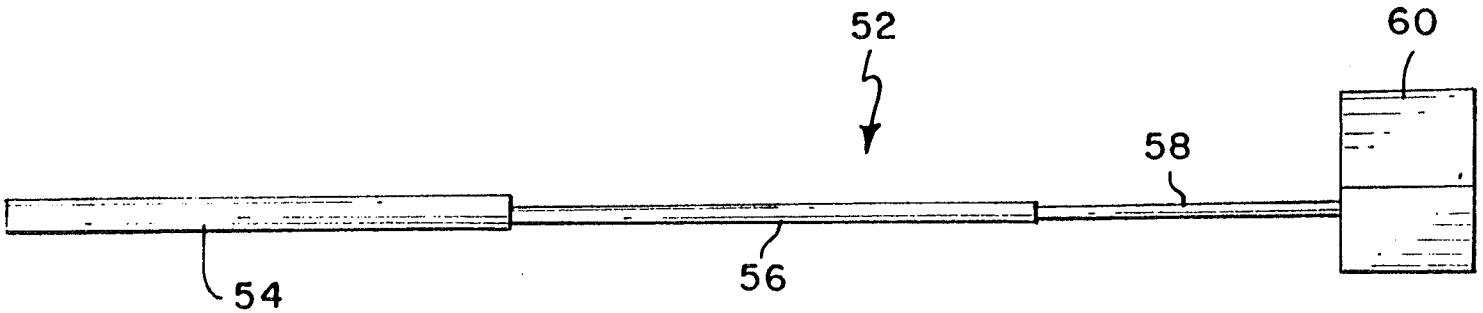
FIG. 6 is a front view of the page turner holder used in the Page Turning System.
Figure 7:
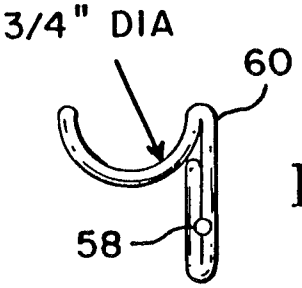
FIG. 7 is a side view of the page turner holder used in the Page Turning System.

To store page turner 40 when not in use, a page turner holder 52, shown in FIGS. 6 and 7 is provided. It consists of three telescoping tubes 54, 56, and 58 and an end 60. End 60, shown in side view in FIG. 7, is merely a bent metal bracket enabling the user 80 to place page turner 40 in after he or she is finished turning the pages. It can be mounted on bracket 12 of book holder 10 or in another location if desired.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A device for holding reading materials for use by readers without arm mobility adapted to hold the reading materials in position for reading with the pages displayed to enable turning by means of a rubber tipped stick held in the mouth comprising:

a pair of rectangular frames for holding and positioning said reading material opened in reading posture with said pages displayed at a substantially unobstructed sighting position for reading;

said pair of rectangular frames connected to one another by a hinge such that the angle between said frames may be varied thereby varying the inclination of said reading materials;

an adjustable brace and a spring means affixed between said pair of rectangular frames;

means for holding opposing pages of said reading material open for reading without substantial visual interference of said pages, said means adjustable to the page thickness of said reading material and said means having a variable friction adjustment so as to enable to force of said means against said pages to be varied, said means also permitting manipulation of said pages by said rubber tipped stick employed by said reader;

said means for holding opposing pages of said reading material open for reading without substantial visual interference of said pages comprises a pair of bent wires, each said bent wire mounted to a pair of wire mounts slideably mounted to a threaded rod affixed to one said frame having a spring thereon to provide a spring bias on said wire mounts, said spring bias adjustable by turning a nut threadably attached to said rod; and said rubber tipped stick employed by said reader comprising at least one hollow tube having a shaped tip and a mouthpiece shaped so as to be gripped by the teeth of said reader.

2. The device for holding reading materials for use by readers without arm mobility of claim 1 wherein said stick employed by said reader comprises at least two hollow tubes, one inside the other, so as to make the length of said stick adjustable.

3. The device for holding reading materials for use by readers without arm mobility of claim 2 wherein said shaped tip of said stick employed by said reader comprises an eraser shape.

4. The device for holding reading materials for use by readers without arm mobility of claim 2 wherein said shaped tip of said stick employed by said reader comprises a suction cup shape.

* * * * *